US005984417A

United States Patent [19]

Wang

[11] Patent Number: 5,984,417

[45] Date of Patent: Nov. 16, 1999

[54] BEAM MEMBER FOR FURNITURE

[76] Inventor: Chih Chiang Wang, 2 F., No. 3, Lane 280, Chung-Chan Rd., Hsin Tien City, Taipei Hsien, Taiwan

[21] Appl. No.: 09/231,541

[22] Filed: Jan. 14, 1999

[51] Int. Cl.[6] ..... A47C 7/00

[52] U.S. Cl. ..... 297/440.14; 297/440.1; 297/440.2; 297/440.22; 297/452.2; 297/451.8; 108/158.11; 108/158.12; 248/188.1; 248/225.11

[58] Field of Search ..... 297/440.1, 440.13, 297/440.14, 440.15, 440.16, 440.2, 440.21, 440.22, 440.23, 452.2, 448.1, 451.8, 451.13, 463.1; 108/157.1, 158.11, 158.12; 248/188.1, 223.41, 225.11

[56] References Cited

U.S. PATENT DOCUMENTS

| | | | |
|---|---|---|---|
| 3,982,785 | 9/1976 | Ambasz | 297/440.14 |
| 4,163,537 | 8/1979 | Mourgue | 108/158.12 X |
| 4,177,784 | 12/1979 | Piretti | 108/158.12 |
| 4,435,103 | 3/1984 | Becker et al. | 297/440.1 X |
| 4,463,057 | 7/1984 | Knurr | 248/188.1 X |
| 4,901,971 | 2/1990 | Connelly | 248/225.11 X |

*Primary Examiner*—Laurie K. Cranmer
*Attorney, Agent, or Firm*—Pro-Techtor International Services

[57] ABSTRACT

Disclosed is a beam member for furniture and mainly including a long body having an ellipse-shaped cross section. Two symmetrical L-shaped rails are formed along outer surface of an upper half of the long body to define a sector-shaped channel between them. A similar L-shaped rail and a linear groove are formed along outer surface of a lower half of the long body, and a closed channel having a locating recess is formed inside the long body between the lower L-shaped rail and the linear groove. Different members, such as seat members, back members, supporting arms and leg members, may be correspondingly connected to the L-shaped rails and the channels to form different articles of furniture. The wide usage of the beam member in different furniture enables it to be produced in large quantity at reduced cost.

13 Claims, 12 Drawing Sheets

BEAM MEMBER FOR FURNITURE

BACKGROUND OF THE INVENTION

The present invention relates to a beam member for furniture, and more particularly to a multipurpose beam member for built-up furniture, including chairs, row chairs, tables, signboards, screens, coat and hat racks, etc.

The term "furniture" used hereinafter shall include chairs, row chairs, tables, signboards, screens, coat and hat racks, etc. that are commonly used in our daily life. To make these furniture, it is usually necessary to select and cut materials, transport the cut materials to manufacturers, assemble the half-finished products, and paint the finished products. There are several factors that adversely affect the mass production and accordingly the cost of furniture. First, to meet different requirements of general consumers, the furniture manufacturers tend to produce a variety of differently shaped furniture each having limited quantity. It is therefore inevitable that increased costs are needed for materials of different specifications in low quantities. Second, there are not sections suitably designed for commonly use in more than one type of furniture to simplify the production of furniture.

It is therefore tried by the inventor to develop a beam member for furniture that can be manufactured by mass production for use with other different sections to form multiple types of built-up furniture at lowered costs.

SUMMARY OF THE INVENTION

A primary object of the present invention is to provide a beam member for furniture that can be manufactured by mass production to reduce the cost thereof.

Another object of the present invention is to provide a beam member to which other sections may be assembled in different manners to form a variety of furniture at reduced cost.

To achieve the above and other objects, the beam member of the present invention mainly includes a long body having an ellipse-shaped cross section. Two symmetrical L-shaped rails are formed along outer surface of an upper half of the long body to define a sector-shaped channel between them. A similar L-shaped rail and a linear groove are formed along outer surface of a lower half of the long body, and a closed channel having a locating recess is formed inside the long body between the lower L-shaped rail and the linear groove. Different members, such as seat members, back members, supporting arms and leg members, may be correspondingly connected to the L-shaped rails and the channels to form different articles of furniture. The wide usage of the beam member in different furniture enables it to be produced in large quantity at reduced cost.

BRIEF DESCRIPTION OF THE DRAWINGS

The above and other objects of the present invention and the features and functions thereof can be best understood by referring to the following detailed description of the preferred embodiments and the accompanying drawings, wherein.

DETAILED DESCRIPTION OF THE PREFERRED EMBODIMENTS

Figure 1:
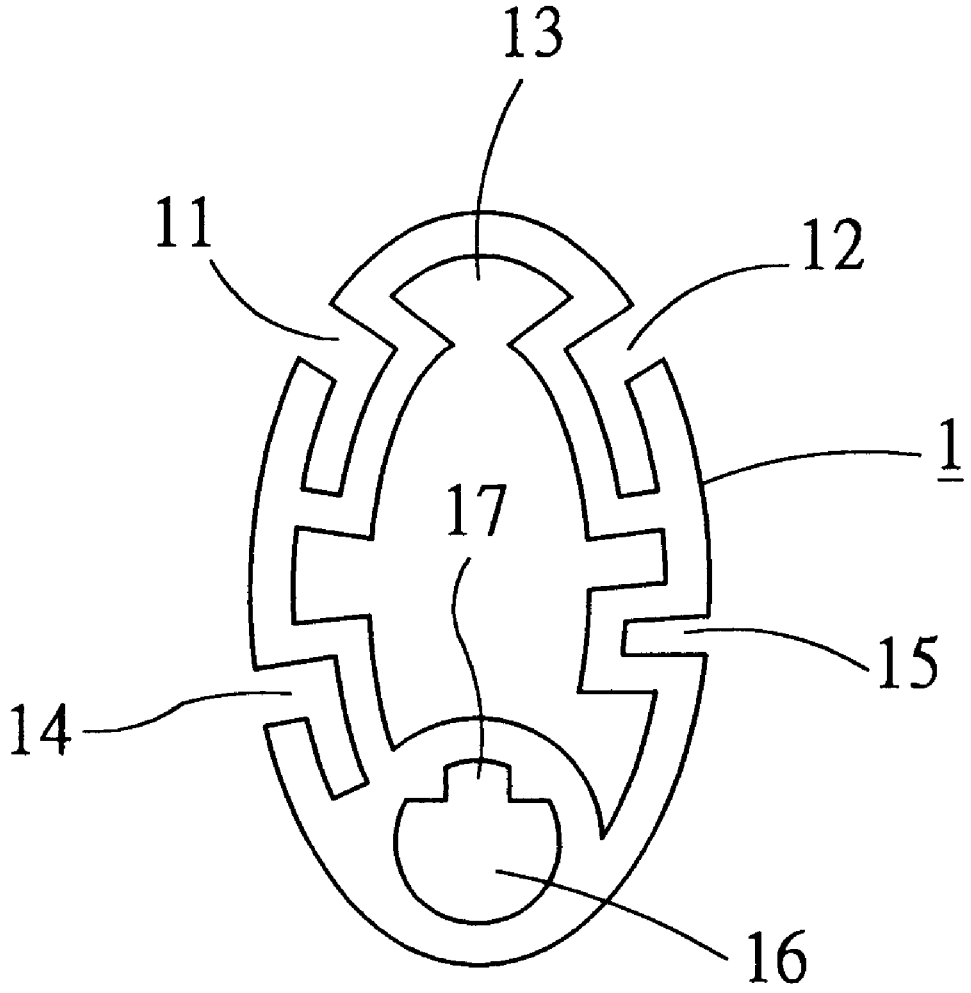
FIG. 1 is a cross sectional view of the beam member for furniture according to the present invention.

The present invention provides a beam member 1 having a long body and an elliptic cross section as shown in FIG. 1. The sectionally ellipse-shaped long body of the beam member 1 can be generally divided into an upper and a lower half. Along an outer surface of the upper half of the beam member 1, two laterally symmetrical L-shaped rails 11, 12 are formed to extend longitudinally, such that a generally sector-shaped open channel 13 is formed between them with the open side thereof facing toward an inner side of the long body. The lower half of the beam member 1 is formed at one side of its outer surface with a longitudinally extended L-shaped rail 14 similar to rails 11 and 12, and at the other side with a longitudinally extended linear groove 15. A closed channel 16 is formed between the rail 14 and the groove 15 to longitudinally extend along an inner surface of the lower half of the beam member 1 and adjacent to the rail 14. A portion of an inner wall of the channel 16 adjacent to the outer surface of the beam member 1 is smoothly curved while another portion of the inner wall of the channel 16 near the inner side of the beam member 1 depresses to form a locating recess 17.

Figure 2:
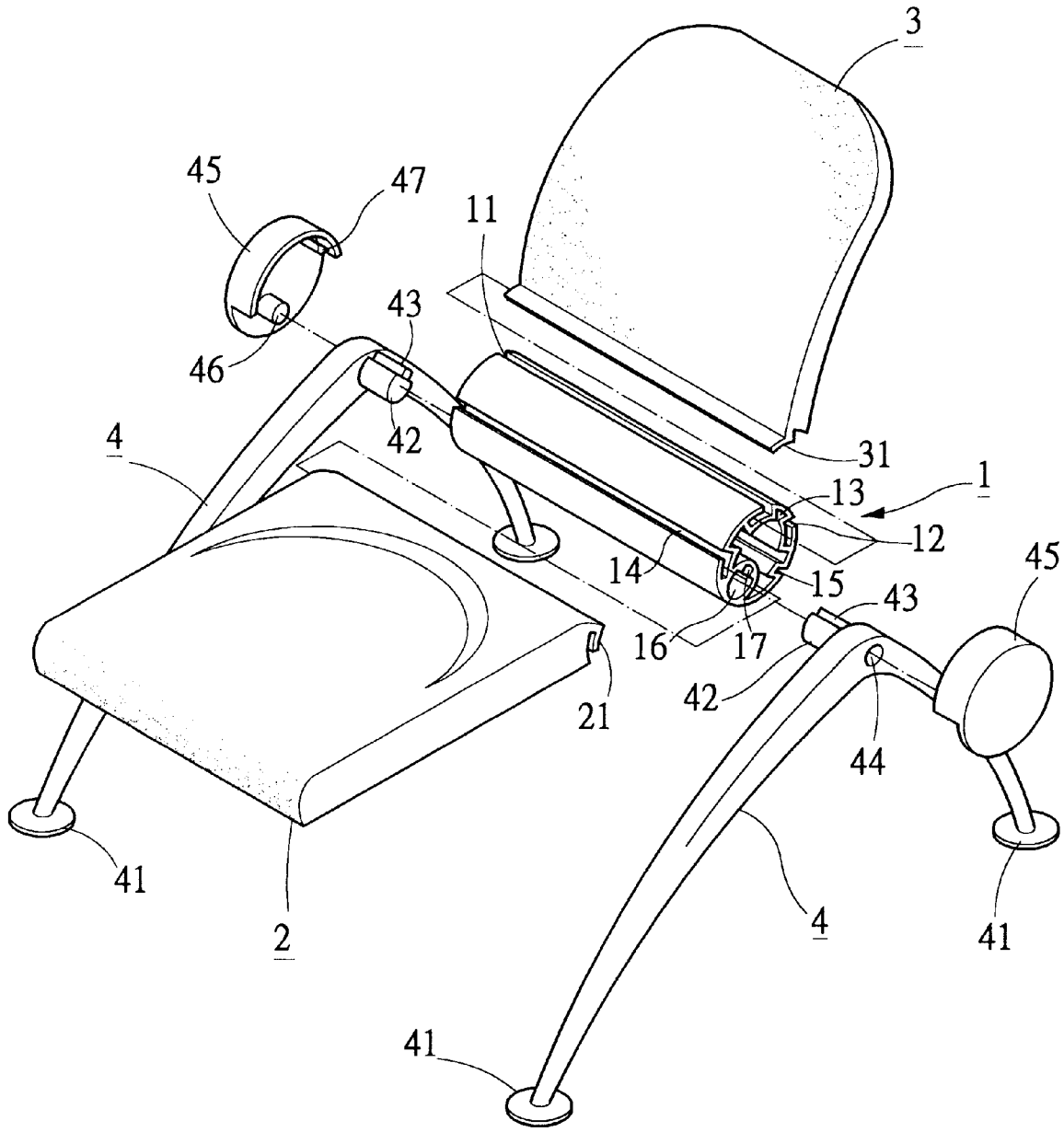
FIG. 2 is an exploded perspective of an embodiment of a built-up chair using the beam member of the present invention.
Figure 3:
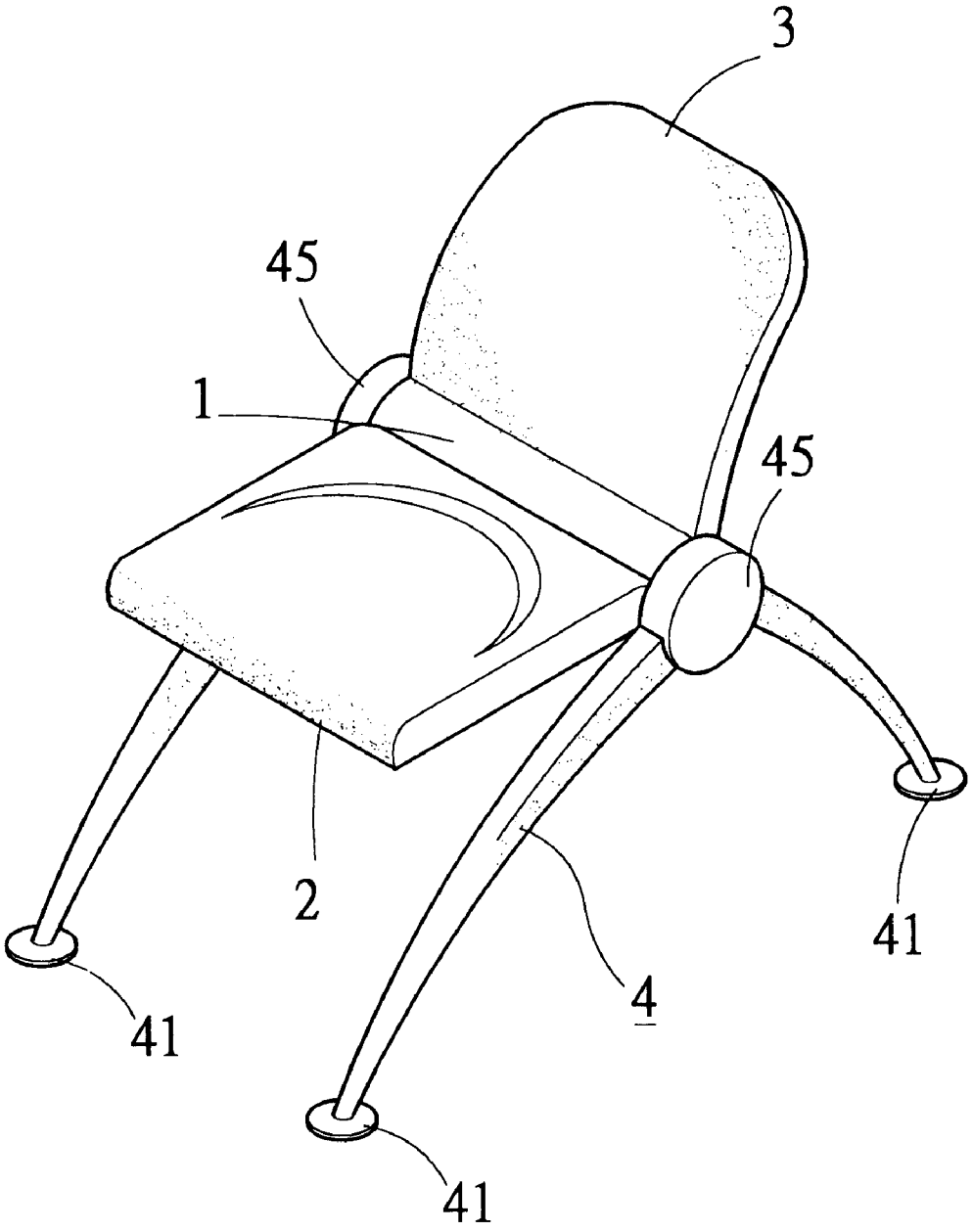
FIG. 3 is an assembled perspective of the built-up chair of FIG. 2.
Figure 4:
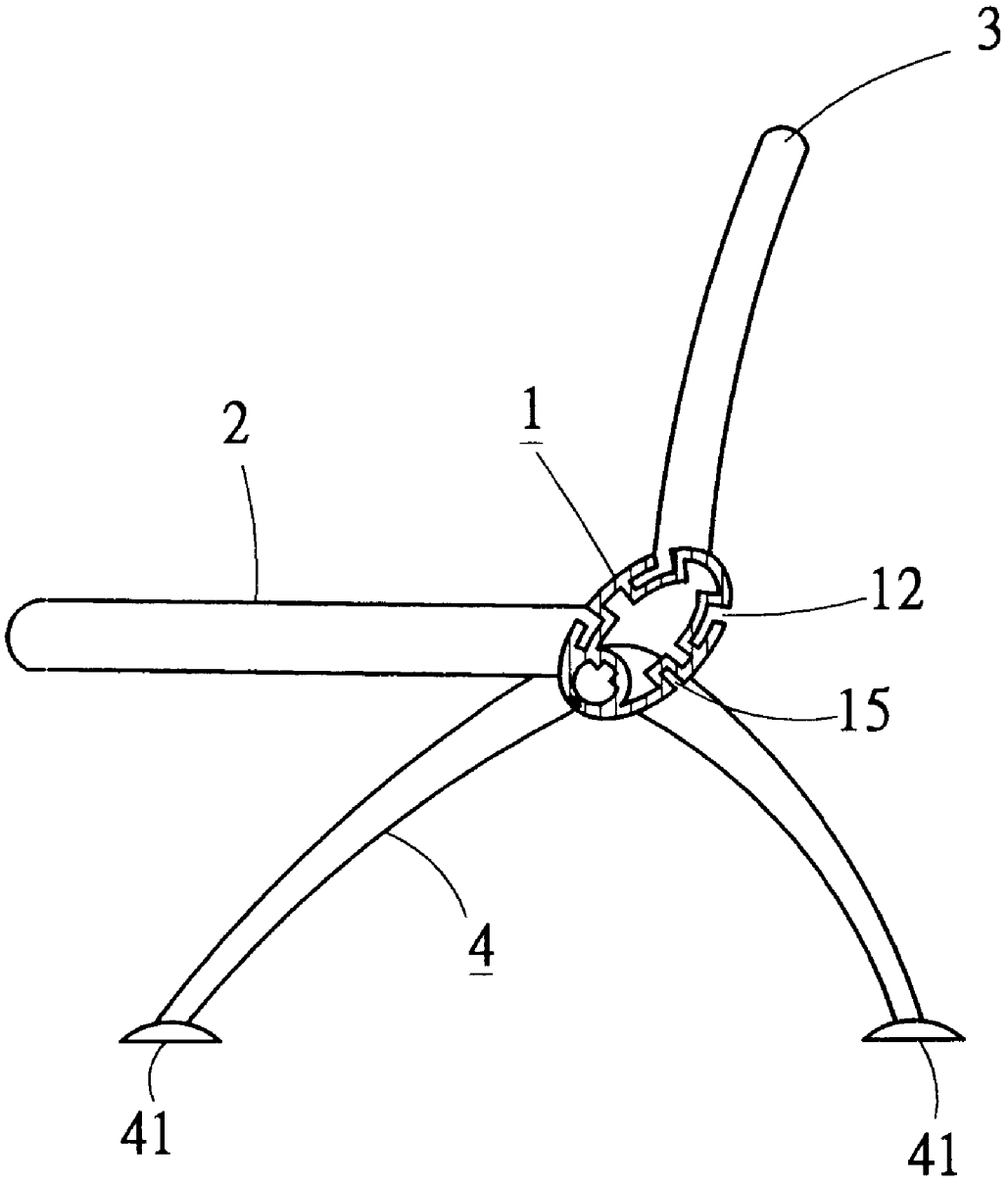
FIG. 4 is a side sectional view of the built-up chair of FIG. 3.

FIG. 2 is an exploded perspective of an embodiment of a built-up chair formed by assembling the beam member 1 of the present invention and other sections together. To form the chair, first lay the beam member 1 horizontally with the side having the linear groove 15 slightly inclining downward by an angle of 45 degrees. Then, a seat member 2 having a rear engaging edge 21 contoured corresponding to the rail 14 is assembled to the beam member 1 by engaging the engaging edge 21 with the rail 14. A back member 3 having a lower engaging edge 31 contoured corresponding to the rail 11 is assembled to the beam member 1 by engaging the lower engaging edge 31 with the rail 11. A leg member 4, which is preferably an upward arched member with adequate height to form two lower ends mounted with expanded pads 41, is then assembled to one end of the beam member 1. The leg member 4 is formed at a center of an inner side facing the beam member 1 with a tenon 42. The tenon 42 includes a protrusion 43 such that the tenon 42 and the protrusion 43 together have a profile corresponding to the overall shape of the closed channel 16 and the locating recess 17, allowing the leg member 4 to assemble to the 45-degree inclined beam member 1 by inserting the tenon 42 into the closed channel 16. Thereafter, another leg member 4 is assembled to the other end of the beam member 1 in similar manner. An insertion hole 44 is provided on each leg member 4 at an outer side opposite to the tenon 42. Finally, an end cover 45 including an inward projected tenon 46 corresponding to the insertion hole 44 and a sector-shaped tenon 47 corresponding to the open channel 13 is fixed to each leg member 4 to cover one end of the beam member 1 by inserting the tenon 46 into the hole 44 and the sector-shaped tenon 47 into the channel 13. A complete built-up chair formed from the beam member 1 and the matching sections, including the seat member 2, the back member 3, and the leg members 4 and end covers 45, is shown in FIG. 3. As can be more clearly seen from FIG. 4, which is a side sectional view of the chair of FIG. 3, the 45-degree inclined beam member 1 enables the seat member 2 engaged into the rail 14 to extend forward in a horizontal position and the back member 3 engaged into the rail 11 to erect in a slightly rearward inclined position for a user to sit comfortably.

Figure 5:
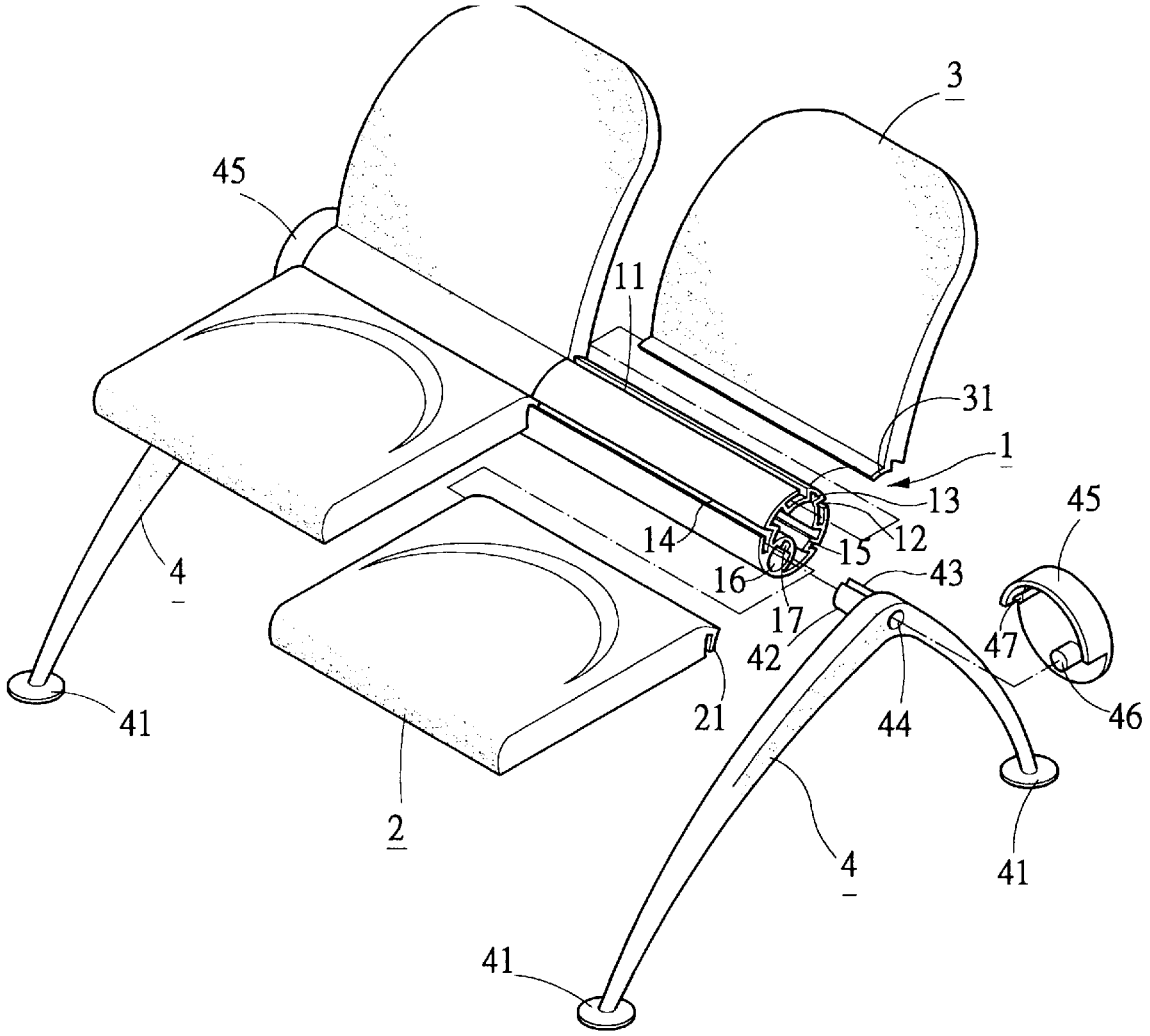
FIG. 5 is an exploded perspective of an embodiment of a row chair using the beam member of the present invention.
Figure 6:
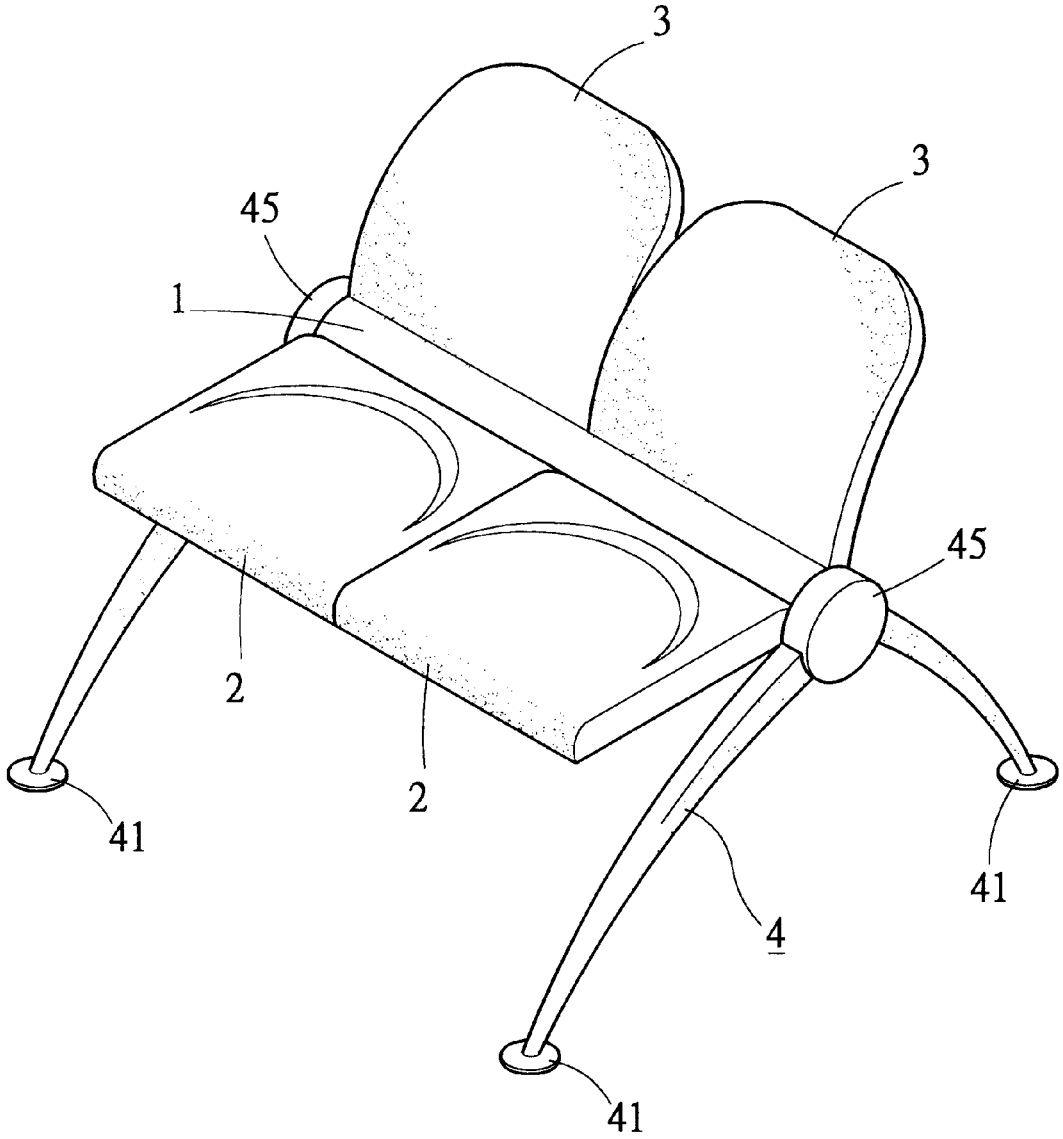
FIG. 6 is an assembled perspective of the row chair of FIG. 5.

Please now refer to FIG. 5 that is an exploded perspective of an embodiment of a built-up row chair formed by assembling the beam member 1 of the present invention and other sections together. To form the row chair of FIG. 5, a beam member 1 having a predetermined length is laid horizontally with the side having the linear groove 15 slightly inclining downward by an angle of 45 degrees. Two seat members 2 are sequentially engaged with the rail 14 to extend forward from the beam member 1 side by side. Two back members 3 are also sequentially engaged with the rail 11 to erect on the beam member 1. Then, assemble two leg members 4 to two outer ends of the beam member 1 and cover the ends with two end covers 45. FIG. 6 shows a complete row chair formed from the beam member 1 of the present invention and other matching members. Since the matching members used to form the row chair of FIG. 6 have the same structures as that of the members used to form the chair of FIG. 3, they are not repeatedly described herein. What is to be noted is the beam member 1 can be cut to any suitable length for forming a row chair having desired numbers of seats.

Figure 7:
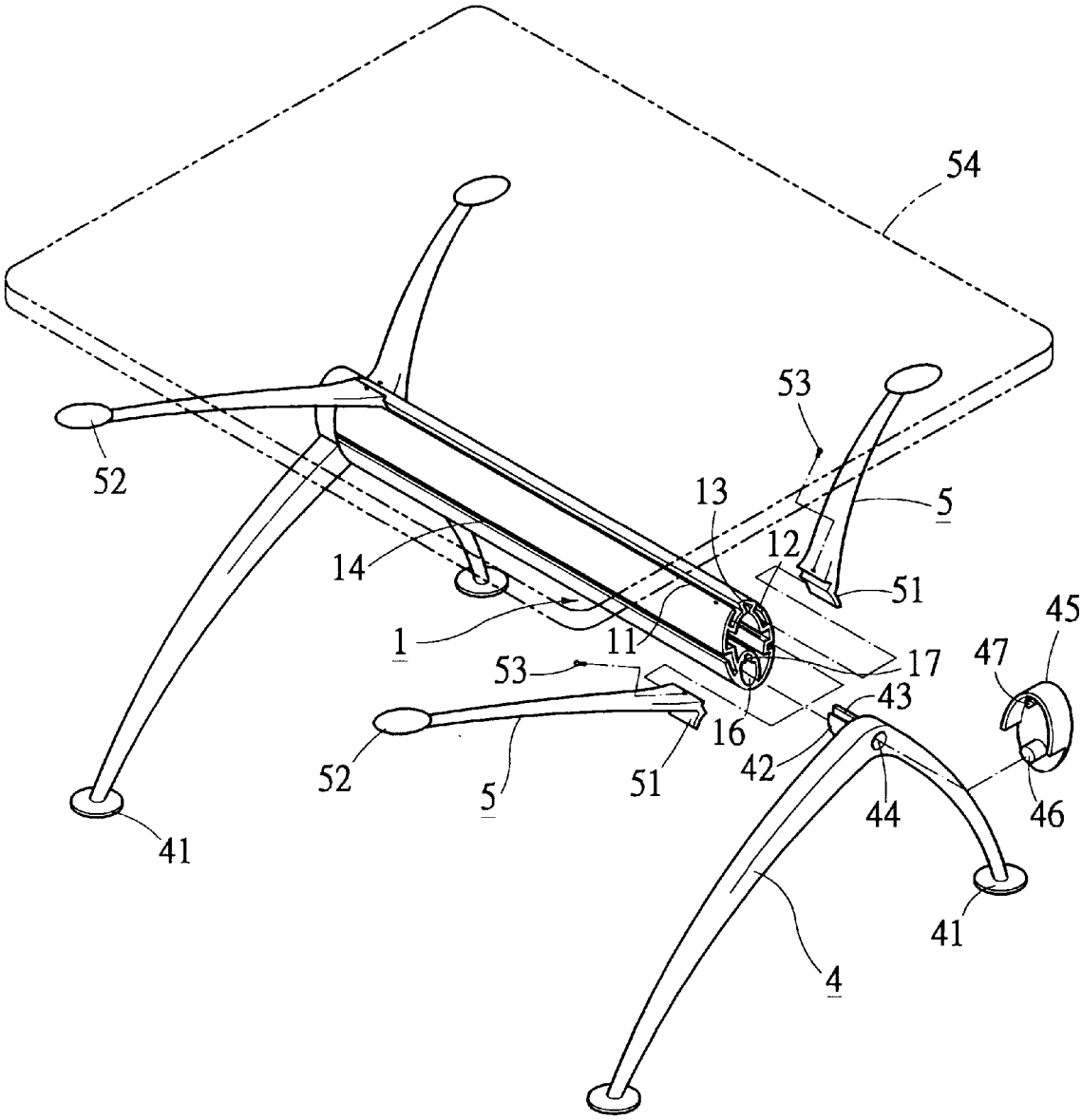
FIG. 7 is an exploded perspective of an embodiment of a table using the beam member of the present invention.
Figure 8:
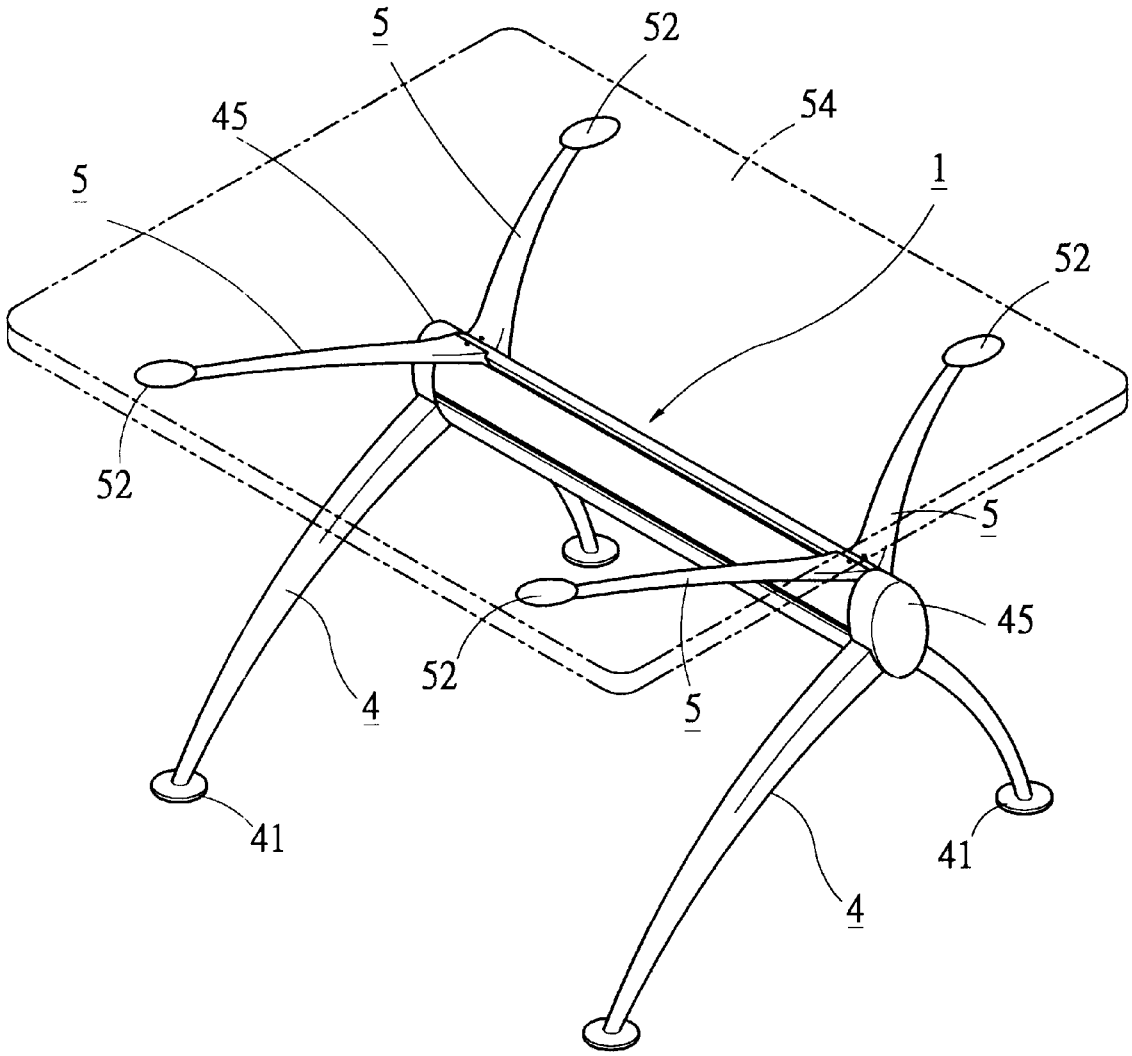
FIG. 8 is an assembled perspective of the table of FIG. 7.

FIG. 7 is an exploded perspective of an embodiment of a table formed from the beam member 1 of the present invention and other matching sections. To form the table, the beam member 1 is cut to a desired length and laid horizontally with the locating recess 17 of the closed channel 16 pointing upward without inclination. Two supporting arms 5 having inner engaging edges 51 corresponding to the rails 11, 12 and 14 are assembled to the beam member 1 near each end thereof by engaging the inner engaging edges 51 separately into the rails 11 and 12, such that outer ends of the supporting arms 5 having expanded carriers 52 provided thereto extend upward and outward to carry and support a table top 54 thereon (please also refer to FIG. 8). Finally, two leg members 4 similar to that for forming the chair and the row chair of FIGS. 3 and 6, respectively, are assembled to two ends of the beam member 1 and two end covers 45 are fixed to the leg members 4 to cover the ends of the beam member 1. In this case, it is noted the protrusion 43 of the tenon 42 on the leg member 4 is located at a position suitable for inserting into the non-inclined locating recess 17 of the closed channel 16 of the beam member 1, such that the table top 54 supported on the supporting arms 5 is always maintained in a horizontal position. FIG. 8 is an assembled perspective of a complete table formed from the above steps. To ensure the supporting arms 5 to be firmly assembled to the beam member 1 without undesired movement, simple fastening means, such as screws 53, can be used to screw the supporting arms 5 to the beam member 1.

Figure 9:
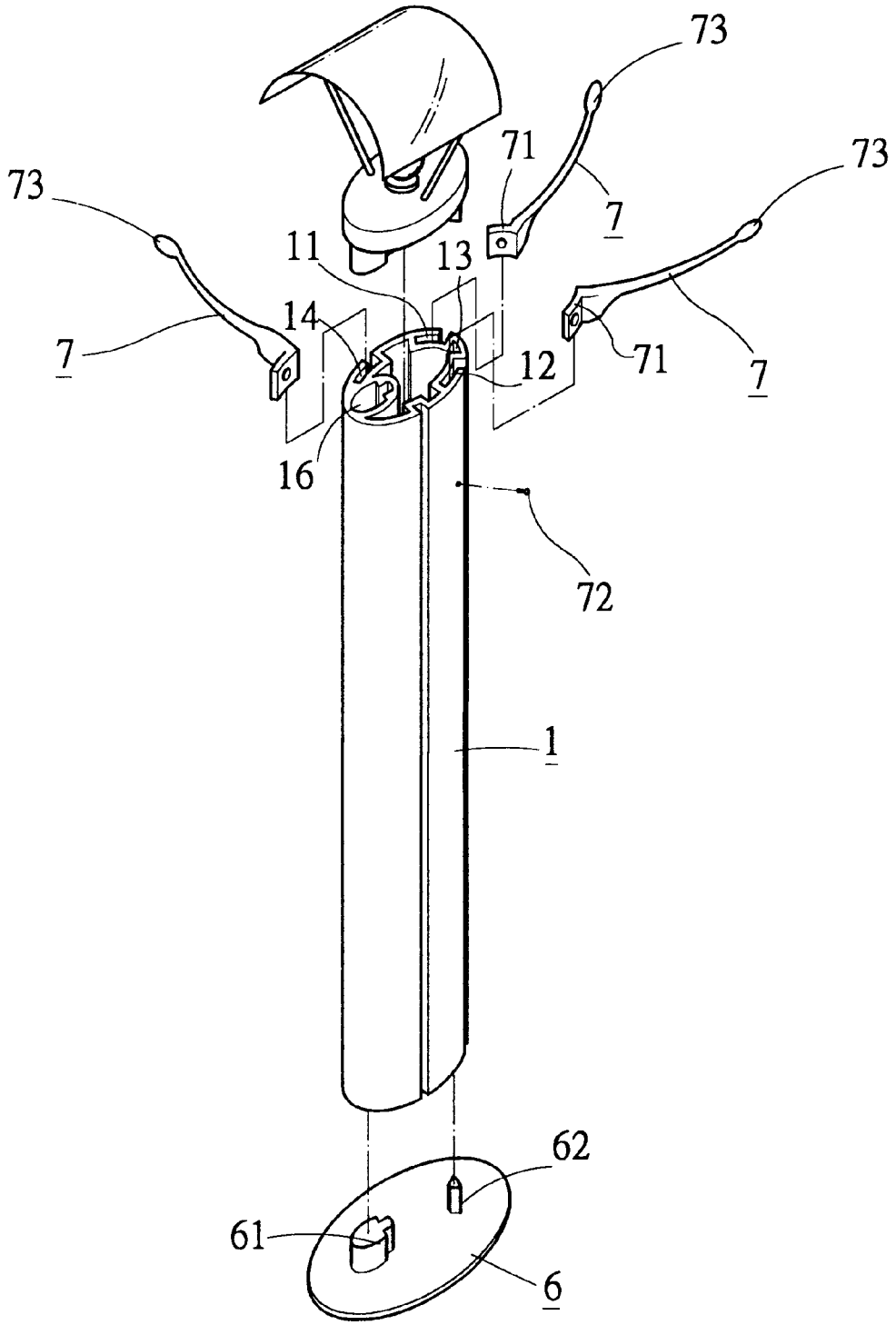
FIG. 9 is an exploded perspective of an embodiment of a coat and hat rack using the beam member of the present invention.
Figure 10:
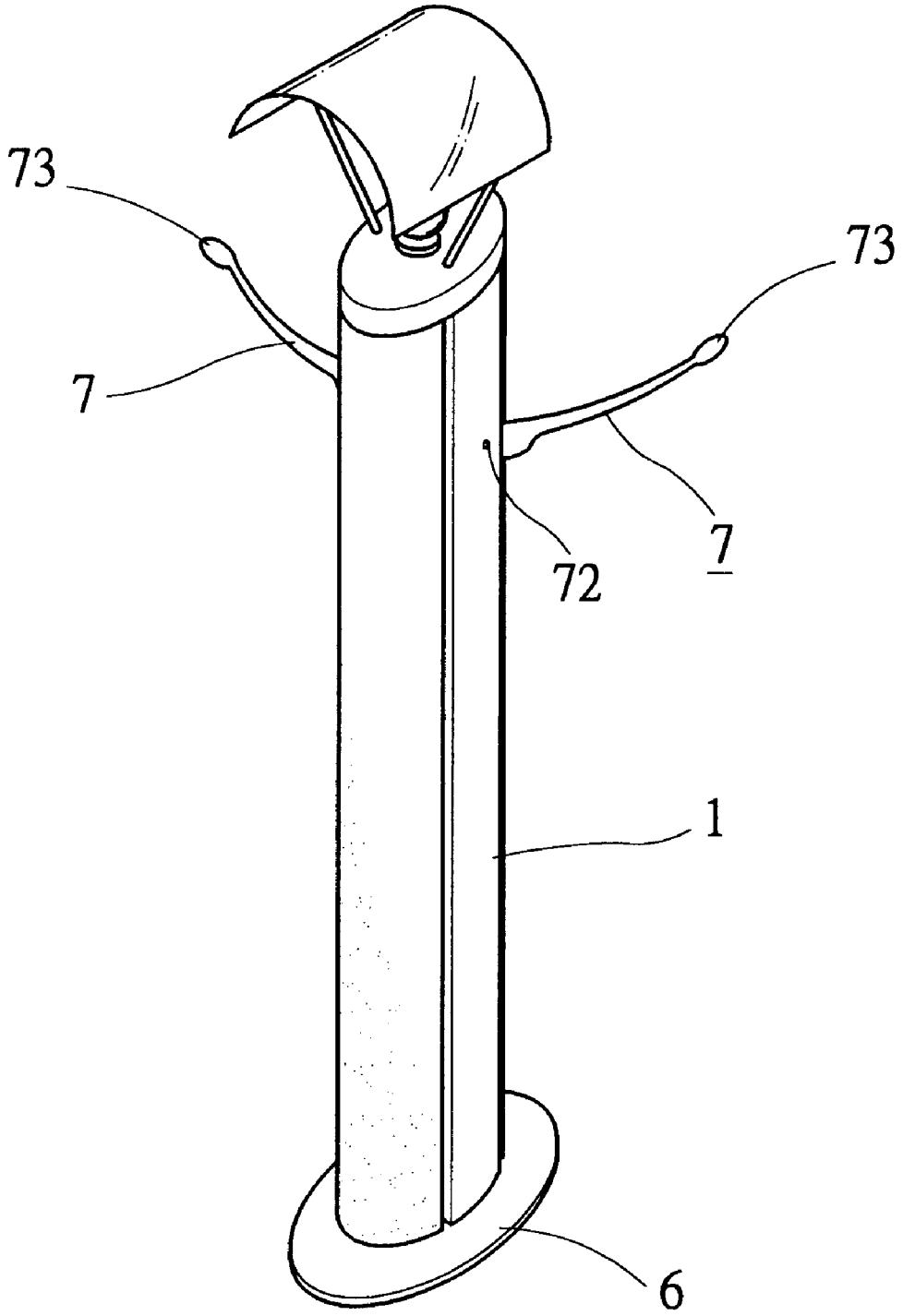
FIG. 10 is an assembled perspective of the coat and hat rack of FIG. 9.

Please refer to FIG. 9 that is an exploded perspective of an embodiment of a coat and hat rack formed by assembling the beam member 1 of the present invention and other matching members together. To form the coat and hat rack, the beam member 1 is cut to a desired length and positioned vertically. A base member 6 having a generally T-shaped tenon 61 and a generally sector-shaped tenon 62 projected from an upper surface thereof is connected to a bottom end of the vertical beam member 1 by engaging the T-shaped tenon 61 into the closed channel 16 and the locating recess 17 and the sector-shaped tenon 62 into the open channel 13, so that the vertical beam member 1 stably stands without easily tilting over. Hangers 7 having inner engaging ends 71 corresponding to the rails 11, 12 and 14 are separately engaged with the rails 11, 12 and 14 and are further firmly fixed to the beam member 1 by screws 72 or similar fastening means. The hanger 7 has a ball-shaped outer end 73 that prevents coat or hat or other article hung on the rack from falling. A top cover, which is structurally similar to the base member 6, is attached to an upper end of the vertical beam member 1 to close the same. A bulb and lampshade may be mounted onto the top cover to provide the rack with additional lighting and decorative functions. Since this is not the subject to be claimed in the present invention, it is not described in details. FIG. 10 is an assembled perspective of a complete coat and hat rack formed from the above steps.

Figure 11:
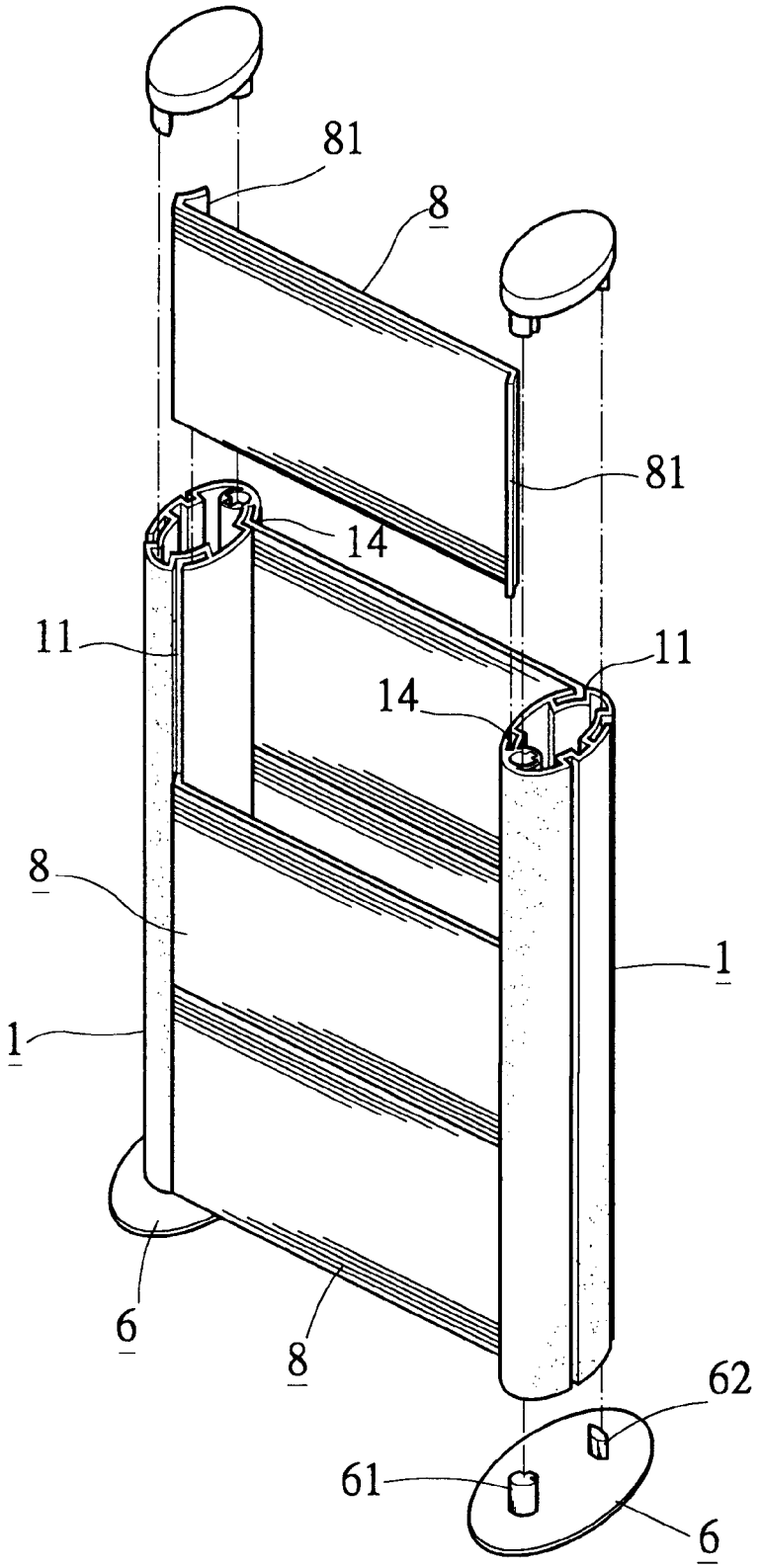
FIG. 11 is an exploded perspective of an embodiment of a screen using the beam member of the present invention.
Figure 12:
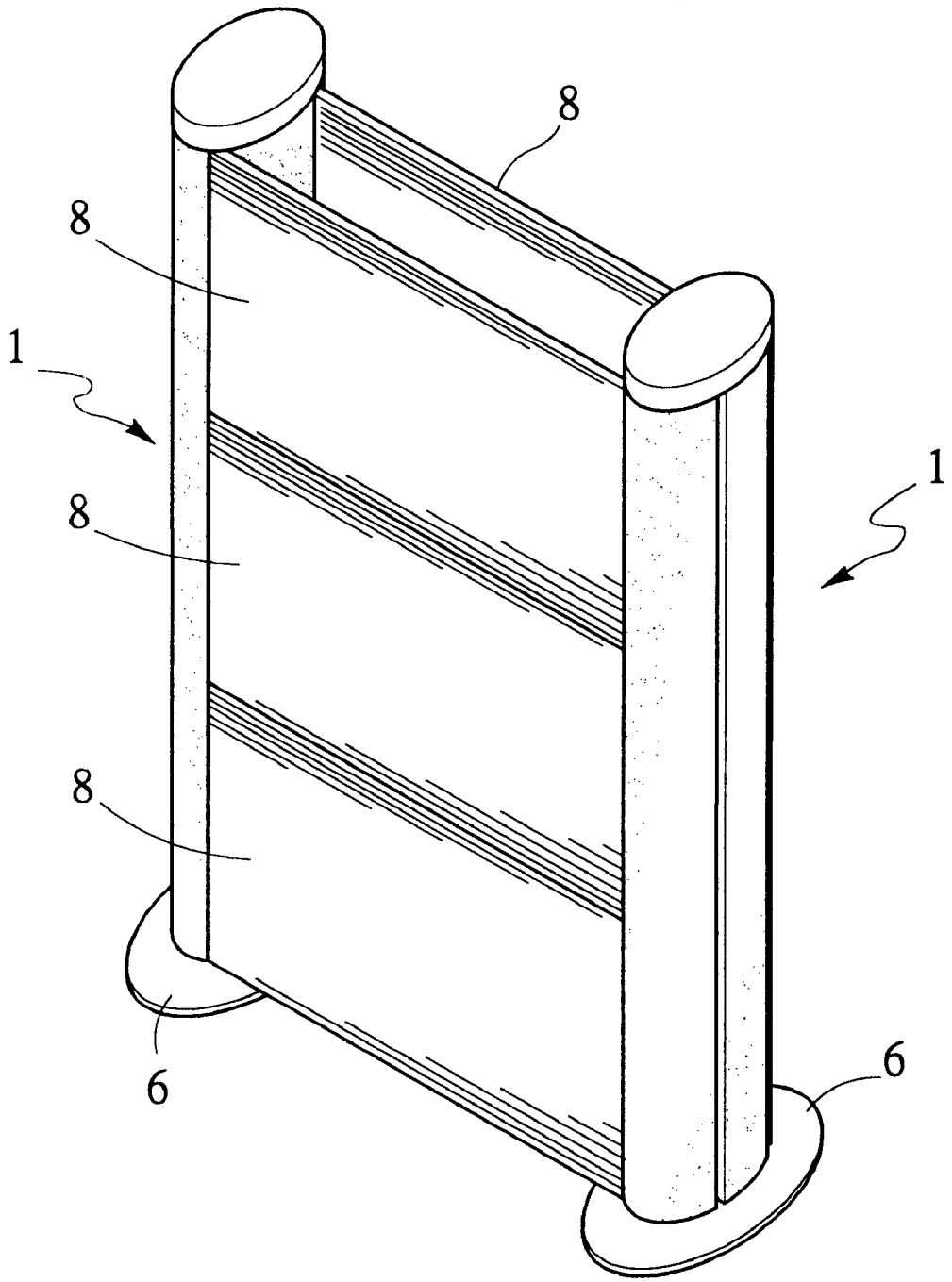
FIG. 12 is an assembled perspective of the screen of FIG. 11.

Please now refer to FIG. 11 that is an exploded perspective of an embodiment of a screen formed by assembling the beam member 1 of the present invention and other matching sections together. To form the screen of FIG. 11, two beam members 1 are cut to the same desired length and vertically positioned face-to-face with each other with the sides having linear grooves 15 facing outward. A partition board 8 having two distal ends 81 configured corresponding to the shape of the rails 11 and 14 is transversely located between the two beam members 1 by engaging its two distal ends with the rails 11 and 14 separately on the two beam members 1. Another partition board 8 may also be transversely located between the two beam members 1 to face the first partition board 8 by engaging two distal ends 81 thereof into another rails 11 and 14 separately on the beam members 1. Additional partition boards 8 may be sequentially mounted between the two beam members 1 above the first two partition boards 8 in the same manner as above described until a desired height of the screen has been reached. Base members 6 and top covers similar to that used in forming the above coat and hat rack are again used to seal two ends of the vertical beam members 1. FIG. 12 shows the screen of FIG. 11 in an assembled state. The screen may also be used as a signboard.

From the above description, it can be found that the beam member 1 of the present invention is provided with specially designed rails, grooves and channels for firmly holding other functional members at their correspondingly shaped engaging ends, such that a variety of articles can be assembled from the beam member and these other functional members. The wide usage of the beam member in different furniture pieces enables it to be manufactured by mass production and is therefore helpful in reducing the manufacturing costs of furniture.

With the above arrangements, the beam member 1 of the present invention has at least following advantages:

1. It can be widely used in differently designed furniture and is therefore suitable for mass production that will advantageously lower the manufacturing cost and selling price of furniture.
2. The linear groove 15 provided on the beam member 1 may be used as an electric wire conduit for the furniture using the beam member 1, such as tables, screens, racks, etc., to conveniently connect to an electric appliance.

3. The beam member 1 has fixed specification that facilitates mass production thereof and formation of different built-up furniture.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A beam member for furniture, comprising a long body having an elliptic cross section that is generally divided into upper and lower halves; a first and a second rail being longitudinally and laterally symmetrically formed along two sides of an outer surface of said upper half of said long body and therefore defining a generally sector-shaped and inward-opened channel between them, a third rail similar to said first and said second rails being longitudinally formed along a lower side of an outer surface of said lower half of said beam member, a linear groove being longitudinally formed along the other side of the outer surface of said lower half, and a closed channel being formed inside said long body between said third rail and said linear groove to longitudinally extend adjacent to said third rail, and a portion of an inner wall of said closed channel depressed toward an inner side of said long body to form a locating recess, whereby other differently designed members may be connected to said beam member by engaging them into said first, said second and said third rails, as well as said open and said closed channels, to together with said beam member form an individual piece of furniture.

2. A beam member for furniture as claimed in claim 1, wherein said first, said second, and said third rails all have an L-shaped cross section.

3. A beam member for furniture as claimed in claim 2, wherein a portion of the inner wall of said closed channel opposite to said locating recess has a smoothly curved surface which together with said locating recess give said closed channel a generally T-shaped cross section.

4. A beam member for furniture as claimed in claim 3, wherein said individual piece of furniture is a chair and said other differently designed members being connected to said beam member include a seat member engaged with said third L-shaped rail at said lower half of said long body, a back member engaged with said first L-shaped rail at said upper half of said long body, and two leg members engaged with said closed channel at two outer ends of said long body; and said leg member each having a tenon formed at a top center of an inner side facing said beam member for fitly inserting into said closed channel while said beam member is slightly downward and rearward inclined toward the side having said linear groove by about 45 degrees, allowing said seat member to extend forward horizontally.

5. A beam member for furniture as claimed in claim 3, wherein said individual piece of furniture is a row chair including more than one seat and said other differently designed members being connected to said beam member include more than one seat member engaged with said third L-shaped rail at said lower half of said long body side by side, more than one back member engaged with said first L-shaped rail at said upper half of said long body side by side, and two leg members engaged with said closed channel at two outer ends of said long body; and said leg member each having a tenon formed at a top center of an inner side facing said beam member for fitly inserting into said closed channel while said beam member is slightly downward and rearward inclined toward the side having said linear groove by about 45 degrees, allowing said more than one seat member to extend forward horizontally.

6. A beam member for furniture as claimed in claim 3, wherein said individual piece of furniture is a table and said other differently designed members being connected to said beam member include at least two pairs of outward and upward extended supporting arms engaged with said first and said second L-shaped rails at said upper half of said long body near two outer ends of said beam member, a table top supported on said supporting arms, and two leg members engaged with said closed channel at two outer ends of said long body; and said leg member each having a tenon formed at a top center of an inner side facing said beam member for fitly inserting into said closed channel while said beam member is in a non-inclined position, allowing said table top to locate a horizontal plane.

7. A beam member for furniture as claimed in claim 3, wherein said individual piece of furniture is a coat and hat rack with one said beam member being vertically erected, and wherein said other differently designed members being connected to said beam member include a base member having tenons for correspondingly inserted into said open and said closed channels of said long body for said beam member to stand stably, and more than one hanger engaged at an inner end with said first, said second, and said third L-shaped rails of said long body and fixedly connected thereto by fastening means.

8. A beam member for furniture as claimed in claim 3, wherein said individual piece of furniture is a screen/signboard having two said beam members being vertically erected to face each other with the sides having said linear grooves facing outward, and wherein said other differently designed members being connected to said beam members include base members having tenons for correspondingly inserted into said open and said closed channels of said long body for said beam members to stand stably, and desired numbers of partition boards having engaging ends formed corresponding to said L-shaped rails and transversely extending between said two vertical beam members with said engaging ends of said partition boards separately engaged with said first L-shaped rail on one said beam member and said third L-shaped rail on the other said beam member.

9. A beam member for furniture as claimed in claim 1, wherein said individual piece of furniture is a chair and said other differently designed members being connected to said beam member include a seat member engaged with said third rail at said lower half of said long body, a back member engaged with said first rail at said upper half of said long body, and two leg members engaged with said closed channel at two outer ends of said long body; and said leg member each having a tenon formed at a top center of an inner side facing said beam member for fitly inserting into said closed channel while said beam member is slightly downward and rearward inclined toward the side having said linear groove by about 45 degrees, allowing said seat member to extend forward horizontally.

10. A beam member for furniture as claimed in claim 1, wherein said individual piece of furniture is a row chair including more than one seat and said other differently designed members being connected to said beam member include more than one seat member engaged with said third rail at said lower half of said long body side by side, more than one back member engaged with said first rail at said upper half of said long body side by side, and two leg members engaged with said closed channel at two outer ends of said long body; and said leg member each having a tenon formed at a top center of an inner side facing said beam member for fitly inserting into said closed channel while said beam member is slightly downward and rearward inclined toward the side having said linear groove by about 45 degrees, allowing said more than one seat member to extend forward horizontally.

11. A beam member for furniture as claimed in claim 1, wherein said individual piece of furniture is a table and said other differently designed members being connected to said beam member include at least two pairs of outward and upward extended supporting arms engaged with said first and said second rails at said upper half of said long body near two outer ends of said beam-member, a table top supported on said supporting arms, and two leg members engaged with said closed channel at two outer ends of said long body; and said leg member each having a tenon formed at a top center of an inner side facing said beam member for fitly inserting into said closed channel while said beam member is in a non-inclined position, allowing said table top to locate in a horizontal plane.

12. A beam member for furniture as claimed in claim 1, wherein said individual piece of furniture is a coat and hat rack with one said beam member being vertically erected, and wherein said other differently designed members being connected to said beam member include a base member having tenons for correspondingly inserted into said open and said closed channels of said long body for said beam member to stand stably, and more than one hanger engaged at an inner end with said first, said second, and said third rails of said long body and fixedly connected thereto by fastening means.

13. A beam member for furniture as claimed in claim 1, wherein said individual piece of furniture is a screen/signboard having two said beam members being vertically erected to face each other with the sides having said linear grooves facing outward, and wherein said other differently designed members being connected to said beam members include base members having tenons for correspondingly inserted into said open and said closed channels of said long body for said beam members to stand stably, and desired numbers of partition boards having engaging ends formed corresponding to said rails and transversely extending between said two vertical beam members with said engaging ends of said partition boards separately engaged with said first rail on one said beam member and said third rail on the other said beam member.

* * * * *